US008627954B2

(12) United States Patent
Giro Amigo

(10) Patent No.: US 8,627,954 B2
(45) Date of Patent: Jan. 14, 2014

(54) STRIP FOR THE FORMATION OF HANDLES OR LABELS FOR FRUIT AND VEGETABLE PRODUCE BAGS

(75) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 0 days.

(21) Appl. No.: 13/639,692

(22) PCT Filed: Mar. 10, 2011

(86) PCT No.: PCT/ES2011/070163

§ 371 (c)(1),
(2), (4) Date: Oct. 23, 2012

(87) PCT Pub. No.: WO2011/124734

PCT Pub. Date: Oct. 13, 2011

(65) Prior Publication Data

US 2013/0039607 A1 Feb. 14, 2013

(30) Foreign Application Priority Data

Apr. 9, 2010 (ES) ..... 201030323 U

(51) Int. Cl.
*B65D 85/24* (2006.01)

(52) U.S. Cl.
USPC ..... 206/338; 383/6; 206/820

(58) Field of Classification Search
USPC ..... 383/6, 8, 13, 15, 25, 26, 29, 30; 206/338, 348, 216, 820; 493/340; 40/299.01
See application file for complete search history.

(56) References Cited

U.S. PATENT DOCUMENTS

| | | | | |
|---|---|---|---|---|
| 2,437,055 | A * | 3/1948 | Thompson | 294/150 |
| 2,722,368 | A * | 11/1955 | Gottsegen | 383/6 |
| 6,234,946 | B1 * | 5/2001 | Fricano | 493/340 |
| 7,654,024 | B2 * | 2/2010 | Riley | 40/633 |
| 2008/0273817 | A1 * | 11/2008 | Giro Amigo | 383/16 |
| 2008/0301981 | A1 * | 12/2008 | Giro Amigo | 40/299.01 |
| 2009/0180717 | A1 * | 7/2009 | Ferrer | 383/117 |
| 2012/0020587 | A1 * | 1/2012 | Giro Amigo | 383/8 |

FOREIGN PATENT DOCUMENTS

| | | | |
|---|---|---|---|
| EP | 1 988 027 | A1 | 11/2008 |
| EP | 2 001 006 | A2 | 12/2008 |
| GB | 1 428 084 | A | 3/1976 |

OTHER PUBLICATIONS

International Search Report for PCT/ES2011/070163, dated Nov. 28, 2011.

* cited by examiner

*Primary Examiner* — Jacob K Ackun
(74) *Attorney, Agent, or Firm* — Sughrue Mion, PLLC

(57) ABSTRACT

A strip for the formation of handles or labels for fruit and vegetable product bags, such as mesh bags, the strip having a linear succession of handles, or labels where appropriate, joined without interruption to the immediately preceding and to the immediately following one, a central portion and two opposite ends being distinguished in each of them, which together with those of the immediately preceding and immediately following handles or labels determine respective joining areas, each handle or label provided in the transition area between each end and its corresponding central portion with at least one recess or depression at its edges, the inner contour of which is made up of a curved or mixed curve line devoid of angles and without inflexion points.

13 Claims, 4 Drawing Sheets

STRIP FOR THE FORMATION OF HANDLES OR LABELS FOR FRUIT AND VEGETABLE PRODUCE BAGS

CROSS REFERENCE TO RELATED APPLICATIONS

This application is a National Stage of International Application No. PCT/ES2011/070163, filed on Mar. 10, 2011, which claims priority from Spanish Patent Application No. 201030323, filed on Apr. 9, 2010, the contents of all of which are incorporated herein by reference in their entirety.

TECHNICAL FIELD OF THE INVENTION

The invention relates to a continuous strip from which successive longitudinal portions especially adapted to be joined, preferably at their two ends, to respective closed constricted ends of a fruit and vegetable product bag to serve as a handle or label are obtained.

BACKGROUND OF THE INVENTION

Patent EP 1988027 discloses a mesh bag formed from a longitudinal portion of tubular mesh the closed constricted ends of which are joined by means of an oblong and flexible element which acts as a handle. These oblong elements which act as a handle are conventionally obtained by transversely cutting a respective continuous strip. The width of each oblong element must be sufficient so that its ends can be folded along the side edges thereof to tightly fit around or surround the corresponding end of the tubular mesh when the operation for joining it to the latter is carried out, for example, by stapling or by welding.

A drawback of this operation is that the deformation made in the ends of the oblong element, in this case the handle, is transmitted to and affects the central portion of the handle, altering its practical width and altering the comfort of the user when grasping the bag such that it is suspended for transport. The deformation of the handle can also make reading the information printed on the handle difficult, where applicable.

A continuous strip for the formation of handles to resolve this drawback is therefore an objective of the present invention.

In addition, it has been observed that the joint between the oblong element and the mesh, especially when they are joined by heat-welding, has a critical area where the joint begins to break by tearing of the handle, when the weld is subjected to a stress that is too great. This critical area is located in each of the fold lines around which the side edges of the oblong element are folded, in the area of its joining with the mesh.

Another objective of the invention is to disclose a continuous strip from which handles can be obtained the ends of which are configured such that when they are joined by heat-welding to the mesh, they give rise to stronger joints and therefore withstand higher tensile stresses.

Another variant of the bag described in EP 1988027 incorporates two oblong elements, both joined to the two closed ends of the longitudinal portion of tubular mesh, one of which acts as a handle and the other as a label. Taking into account this embodiment variant, the invention is also aimed at providing a continuous strip from which labels can be obtained the ends of which are configured such that they can be joined by heat-welding together with and in a manner juxtaposed to the ends of a handle also joined by heat-welding at the ends of a tubular mesh for the formation of a bag according to this other variant described.

DISCLOSURE OF THE INVENTION

The solution for the strip object of the invention is applicable for obtaining both handles and labels. The strip comprises a linear succession of handles, or labels where appropriate, joined without interruption to the immediately preceding and to the immediately following one, a central portion and two opposite ends of shorter length than the central portion being distinguished in each of them, which together with the ends of the immediately preceding and immediately following handles or labels determine respective joining areas where the strip is to be cut along respective imaginary transverse cut lines to separate a handle or label from the strip.

The strip is essentially characterised in that in the transition area between each end and its corresponding central portion, each handle or label is provided with at least one recess or depression at its edges, the inner contour of which is made up of a curved or mixed curve line devoid of angles and without inflexion points.

According to another feature of the invention, the line which makes up the contour of the recess comprises a curved sector of constant radius greater than or equal to 6 mm which reaches or forms the bottom of the recess in the area going towards the end of the handle or label.

In a variant of the invention, the line which makes up the contour of said recesses joins the corresponding edge of the end of the handle or label by means of a vertex in a sharp angular form. The invention also contemplates the aforementioned vertex being bevelled or rounded.

According to another feature of the invention, the line which makes up the contour of the recesses comprises a first sector, which begins at the edge of the end of the handle or label, that is straight or has a tangent which follows a direction essentially transverse to the strip. In a variant of the invention, said first sector merges with the curved sector of constant radius which reaches or forms the bottom of the recess.

According to another feature of the invention, the ends of each handle or label comprise a symmetrical strip portion with respect to the longitudinal axis of the strip of constant width and of a length (s) comprised between 10 and 20 mm.

The variants in which the maximum width (D) of the ends of each handle or label and the minimum width (d) of the joining necks follow the ratio $1.5d \leq D \leq 4d$ are of special interest.

It is envisaged that the recesses can all be equal or different, and according to a variant of the invention, that each joining area is of symmetrical mirror configuration with respect to the longitudinal axis of the strip and the separating imaginary transverse cut line, the notches also being in symmetrical mirror arrangement with respect to the longitudinal axis of the strip and the imaginary transverse cut line. In the event that all the recesses are equal, the embodiment in which the transition area between each end and its corresponding central portion, each handle or label is provided with a single recess or depression at both of its edges, the pair of recesses symmetrically arranged on either side of the strip determining respective necks in the strip of width comprised between 12 and 24 mm, is worth pointing out.

In the context of the present invention, it is understood that the necks form the narrowest portions of the strip.

DETAILED DESCRIPTION OF THE INVENTION

Figure 1:
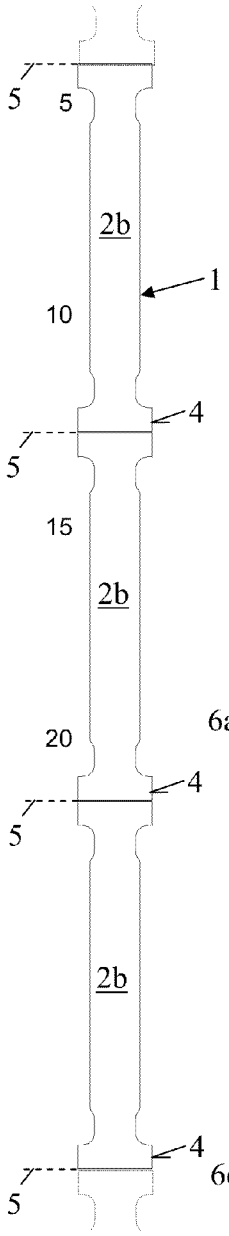
FIGS. 1 and 2*b* depict a longitudinal portion of a first variant of a strip according to the invention, specifically a strip of handles, as well as a separated handle obtained by transversely cutting the strip.
Figure 3:
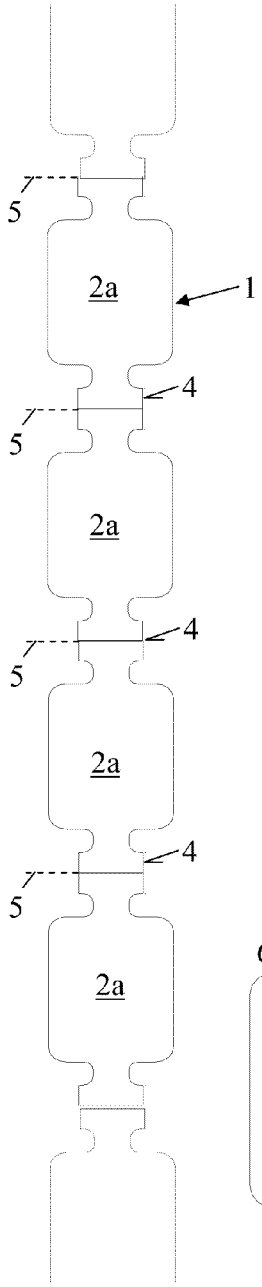
FIGS. 3 and 4 depict a longitudinal portion of a second variant of a strip according to the invention, specifically a strip of labels, as well as a separated label obtained by transversely cutting the strip.

The strip 1 of FIGS. 1 and 3 is a flexible, windable strip of heat-weldable material.

In the example of FIG. 1, the strip 1 is made up of an endless linear succession of identical handles 2*b* joined without interruption to the immediately preceding and to the immediately following one by a respective joining area 4 through the centre of which the strip 1 is to be cut to separate respective handles 2*b*.

In the example of FIG. 3, the strip 1 is made up of an endless linear succession of identical labels 2*a* joined without interruption to the immediately preceding and to the immediately following one by a respective joining areas 4 through the centre of which the strip 1 is to be cut to separate respective labels 2*a*.

The differences between the strips 1 of FIGS. 1 and 3 mainly reside in the shape of the central part of the handle 2*b* and of the strip 2*a* respectively, which are optimal for the function that they must carry out, for example in a bag such as that described in EP 1988027, specifically that variant which incorporates two oblong elements, both joined to the two closed ends of the longitudinal portion of tubular mesh, one of which acts as a handle and the other as a label.

Figure 2A:
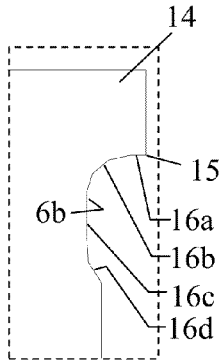
FIG. 2*a* shows in detail a recess of the handle of FIG. 2*b;*
Figure 2B:
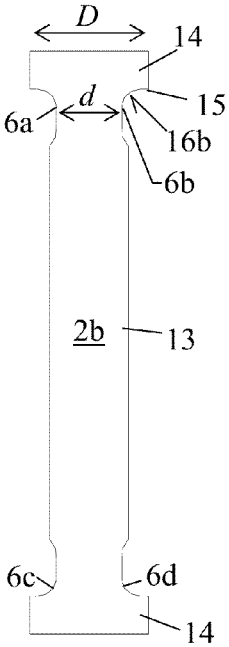
Figure 4:
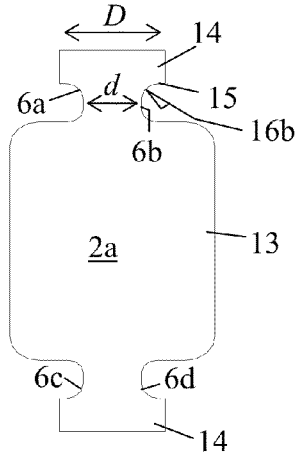

In both cases, a long central portion 13 and two short opposite ends 14, as shown in FIGS. 2*b* and 4, can be distinguished, the length of each of said ends 14 being less than that of the central portion 13. Each end 14 together with the contiguous end of the immediately preceding or immediately following handles or labels of the strip 1 determines a joining area 4 where the strip 1 is to be cut along an imaginary transverse cut line 5 to separate a handle 2*b* or label 2*a* from the corresponding strip 1.

While in the case of the handle 2*b* the total length is optimal for it to act as a handle of a bag, in the case of the label 2*a* depicted by way of example in FIG. 4, its total length is given in order to produce a specific technical effect which consists of performing a strap function and causing the handle 2*b*, once joined to the ends of the bag, to remain in an upright and curved position by default so that it can be readily grasped.

In a practical embodiment, the total length of the handle 2*b* is comprised between 120 and 300 mm, preferably being 215 mm, whereas the total length of the label 2*a* is comprised between 100 and 220 mm, preferably being 160 mm.

In order to avoid deformations in its central portion 13 and to ensure the strength of its joint with the mesh 7, it can be seen that in the transition area between each end 14 and its corresponding central portion 13, each handle 2*b* or label 2*a* is provided with a merging neck formed by a pair of recesses 6*a*, 6*b*; 6*c*, 6*d* in the edges of the strip 1, the inner contour of each recess being made up of a continuous and concave line, devoid of angles and inflexion points.

It can be observed in FIGS. 1 and 3 that the joining areas 4, formed by two contiguous ends 14 of two consecutive handles 2*b* or labels 2*a*, are of symmetrical mirror configuration with respect to the longitudinal axis of the strips 1 and the separating imaginary transverse cut line 5. In other words, the recesses 6*a*, 6*b*, 6*c* and 6*d* are symmetrically arranged with respect to the longitudinal axis of the strips 1 and the aforementioned imaginary transverse cut lines 5.

It is observed in FIGS. 2*b* and 4 that the line that makes up the contour of the recesses 6*a*, 6*b*; 6*c*, 6*d*, in the area going towards its corresponding end 14, joins the corresponding edge of the strip 1 by means of a vertex 15 in a sharp angular form.

Naturally, alternative variants are contemplated in which said edge can be slightly bevelled or rounded, being preferable in this latter case that the radius of curvature is less than 3 mm so that when the side edges of the end 14 of the handle 2*b* or label are folded over the mesh as explained in detail below, they cover the mesh to a greater extent. Providing the vertex 15 with bevelling or rounding is advantageous in the manufacture of a bag such as that described in EP 1988027, specifically the variant which incorporates two oblong elements, obtained from two strips according to the present invention, one of which acts as a handle and the other as a label. Portions of said elements must be placed against one another during the manufacture of the bag for joining them to the mesh, precisely the portions provided with the recesses 6*a* to 6*d* being those that are mutually placed against one another. The presence of a vertex 15 in a sharp angular form in this part of any one of the strips could cause both strips to snag and hinder the progress or movement of one strip with respect to the other during this operation.

It is seen in the detail of FIG. 2*a* that the line which makes up the contour of the recesses 6*a*, 6*b*; 6*c*, 6*d* comprises a first straight sector 16*a* following a direction essentially transverse to the strip 1; a curved sector 16*b* in a circular arc merging with the first straight sector 16*a* and subtending a 90° angle to reach the bottom of the recess; a second straight sector 16*c*, parallel to the longitudinal axis of the strip 1; and a final curved contour sector 16*d* merging with the previous straight sector and connecting with the central portion 13 of the handle 2*b* or label 2*a*.

It is noted that the mere provision of the recesses 6*a*, 6*b*; 6*c*, 6*d* in a conventional uniform strip 1 would have deterred the person skilled in the art from applying the solution of the present invention because for bags containing products the weight of which is to be able to be grasped and transported in suspension with a single hand, which determines the minimum width of the strip 1 taking into account the usual materials (based on polythene and polypropylene) and the interest in material saving, a contour provided with angles, or even with a curved sector with a radius unsuitable for certain bags, favours the breaking of the joint between the mesh 7 and the handle 2*b* because the handle 2*b* is provided with suitable points for triggering the tear of the handle 2*b* when the joining thereof with the mesh 7 is subjected to a tensile stress.

Returning to the variants depicted in FIGS. 2 and 4, a selected contour which advantageously avoids the previously described drawbacks is one in which the curved sector 16*b* in a circular arc has a radius greater than or equal to 6 mm.

In the depicted examples which aim to optimise the material used, each handle 2*b* or label 2*a* is provided with a single recess or depression at both of its edges in the transition area between each end 14 and its corresponding central portion 13, and each pair of recesses 6*a*, 6*b*; 6*c*, 6*d* symmetrically arranged on either side of the strip determines a respective neck in the strip 1 of width d comprised between 12 and 24 mm.

Figure 5A:
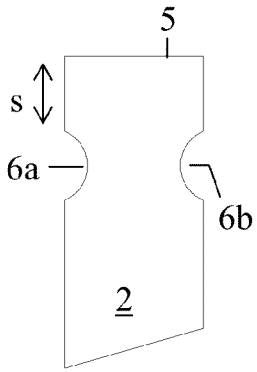
FIGS. 5*a* to 5*f* depict the ends of respective handles or labels obtained by transversely cutting other variants of a strip according to the invention.
Figure 5B:
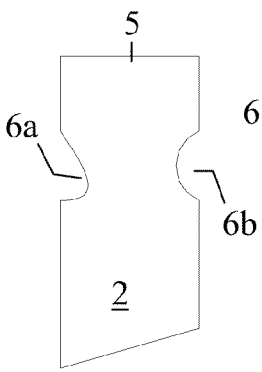
Figure 5C:
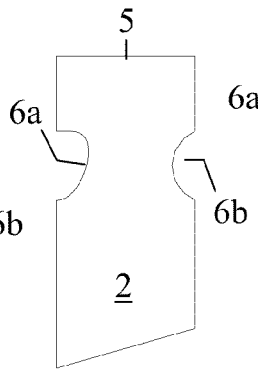
Figure 5D:
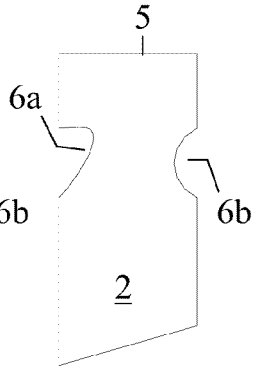

The ends 14 of other variants of handles obtained by transversely cutting respective strips according to other variants of the invention have been depicted in FIGS. 5*a* to 5*c*. Unlike the variants of FIGS. 2 to 4, it is envisaged that the recesses are not symmetrically arranged with respect to the imaginary transverse cut line 5 and/or they are not equal.

In the example of FIGS. 5*a* to 5*d*, the two recesses 6*a* and 6*b* are equidistant from the imaginary cut line 5 but have differences between them. In the variant of FIG. 5*a* the two recesses have a circular arc shape but the recess 6*b* has a radius of curvature greater than that of the recess 6*a*; in the variant of FIG. 5*b*, the recess 6*a* is asymmetrical and the crown of the arc which describes its contour, coinciding with its height, is displaced towards the final sector of the recess 6*a* farthest away from the imaginary cut line 5; in the variant of FIG. 5*c*, the recess 6*a* is also asymmetrical and in this case the crown of the arc which describes its contour, coinciding with its height, is displaced towards the initial sector of the recess 6*a*; and in the variant of FIG. 5*d*, an initial sector closest to the imaginary cut line 5, essentially parallel thereto, is distinguished in the contour of the recess 6*a*.

Figure 5E:
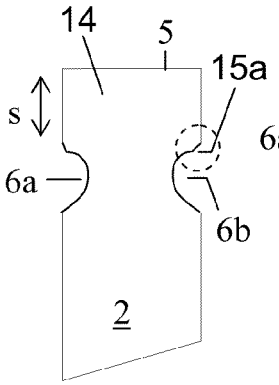
Figure 5F:
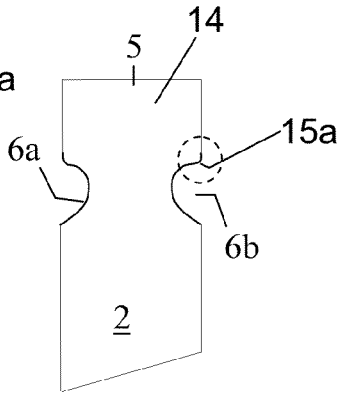

FIGS. 5*e* and 5*f* illustrate variants in which the two vertices 15*a* joining the lines that make up the contours of the recesses, in the area going towards their corresponding end 14 and the edges of the strip 1, have been bevelled in one case and slightly rounded in the other. In said FIGS. 5*e* and 5*f* one of said vertices in each of the depicted variants has been indicated by means of a circle.

Regarding the process for joining with the ends of the bags in the course of manufacture, the strip 1 is to be handled such that the handles 2*b* are not separated before they are joined to the ends of the mesh bags, but rather a joining area 4 of the strip 1 is applied on a previously constricted non-end longitudinal portion of the mesh 7, to subsequently join them by any known means, for example by means of melting the materials which make up the mesh 7 and the strip 1, the joint being of sufficient length to transversely cut it along the imaginary cut line 5 and thus separate two closed ends of the mesh each joined to a corresponding end of two consecutive handles 2*b*.

Figure 8:
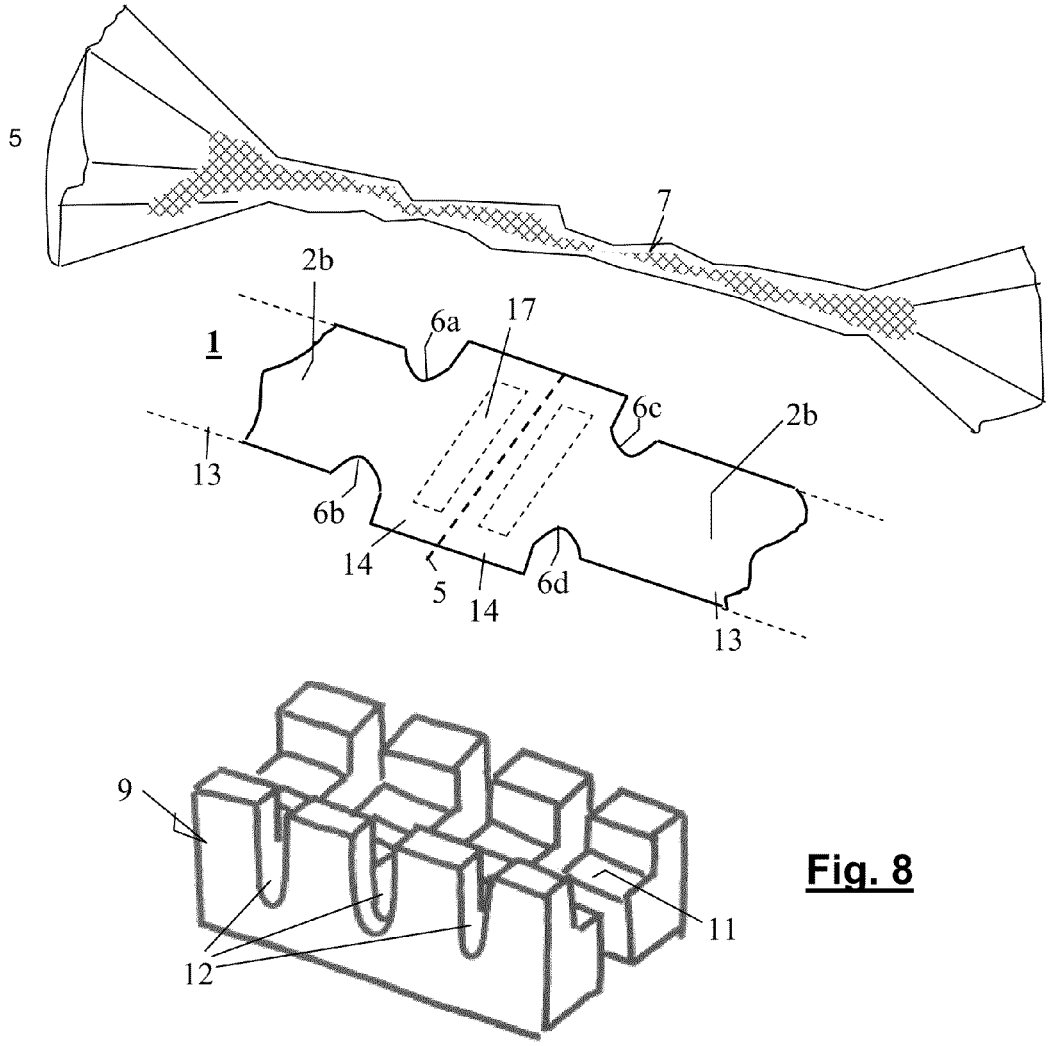
FIG. 8 is a schematic view of a die and of a joining area between two consecutive handles of a strip according to the invention in correlative insertion position prior to performing the operation for closing the mesh.

To correctly form the aforementioned joint, as illustrated in FIG. 8, a strip 1 is selected the joining area 4 of which is of a width greater than that of the longitudinal portion of constricted mesh 7 and said joining area 4, preferably of a length comprised between 20 and 40 mm, is applied in a longitudinal direction thereupon such that respective side bands of the strip project on either side of the constricted mesh. The assembly formed by the strip 1 and the mesh 7 is then introduced by means of a hold-down device in a die 9 such as the one depicted by way of example in FIG. 8, having a considerably U-shaped cross-section and an inner width less than that of the aforementioned joining area 4 of the strip 1 such that the aforementioned side bands of the joining area 4 of the strip 1 remain folded towards the constricted mesh 7. These folded side bands of the strip 1 are then folded over the constricted mesh 7, the two flaps 8*a* and 8*b* depicted in FIGS. 6*a* and 6*b*, which in a subsequent operation are joined to the mesh 7, for example by heat-welding, being formed. Finally, the already joined portions of the constricted mesh 7 and of the strip 1 are transversely cut together. Conventional folding means of the type provided with one or several thrust plates provided with a concave arc suitable for receiving the folded side bands of the strip 1 can be used for folding the flaps 8*a* and 8*b* and for folding them gradually over the mesh 7 as they move towards the bottom 11 of the die 9.

In the example depicted in FIG. 8, the die 9 is provided with several transverse grooves 12 through which corresponding thrust plates, not depicted, of folding means would slide and also a cutting blade would also slide through the central transverse groove 12.

Figure 6A:
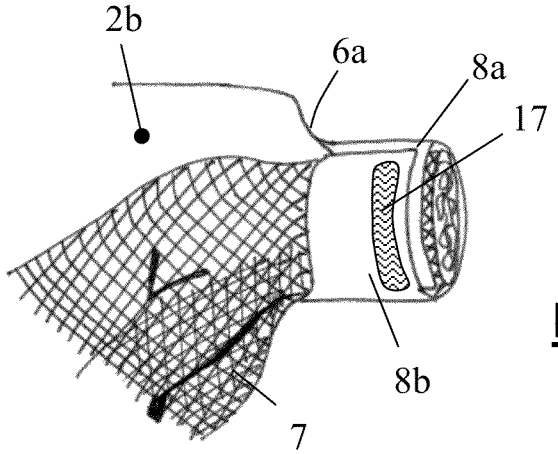
FIGS. 6*a* and 6*b* are respective depictions of the joining area between the end of a handle or label obtained from a strip according to the invention and the closed end of a tight-fitting tubular mesh.

The approximate shape that an end of the handle 2*b* joined to the mesh 7 finally adopts in a preferred embodiment is depicted in FIG. 6*a*, in which the folded side bands 8*a* and 8*b* of the strip 1 on the constricted mesh 7 overlap. To achieve this result while at the same time ensuring maximum strength of the joint between the handle 2*b* and the mesh 7, the maximum width (D) of the ends 14 of each handle 2*b* or label 2*a* and the minimum width d of the necks must preferably follow the ratio $1.5d \leq D \leq 4d$.

Figure 6B:
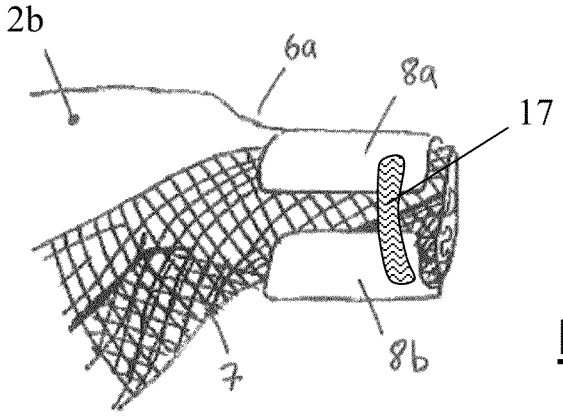

FIG. 6*b* depicts an alternative to the manner of joining depicted in FIG. 6*a*, in which the side bands 8*a* and 8*b* are not overlapping or superimposed.

FIGS. 6*a* and 6*b* particularly show that the folding of the flaps 8*a* and 8*b* on the mesh 7 does not affect the rest of the handle 2*b* due to the effect caused by the recesses 6*a* and 6*b* (the latter is not visible in FIGS. 6*a* and 6*b*), which allow that the deformation of the end of the handle 2*b* is not transmitted to the central portion 13 of the handle 2*b*.

Figure 7:
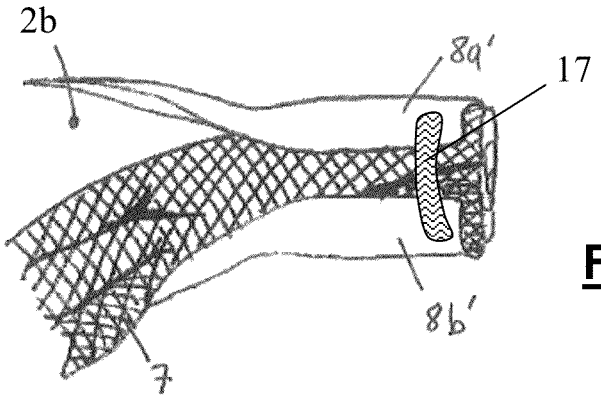
FIG. 7 is a depiction of the joining area between the end of a conventional handle or label and the closed end of a tight-fitting tubular mesh.

In order to show the effect caused by the recesses, the shape adopted by the end of a conventional handle 2*b* joined to the mesh 7 when the strip 1 from which said handle 2*b* is obtained is not provided with the recesses which characterise the invention has also been depicted in an approximate manner in FIG. 7. Tests conducted with the variants depicted in FIGS. 6*a*, 6*b* and 7 have demonstrated that the joint between the handle 2*b* and the mesh 7 by means of a handle 2*b* obtained from a strip 1 according to the invention increases the breaking strength of this joint by means of the tearing of the handle 2*b* by more than 20%. It is noted that in the case depicted in FIG. 6*a*, the superimposed side bands 8*a* and 8*b* prevent the concentration of all the tensile stress on the area in which the heat-welding operation between the mesh 7 and the end 14 of the handle 2*b* is performed, depicted by means of the shaded area 17. The material which forms these superimposed side bands 8*a* and 8*b* enveloping the mesh 7 absorbs part of the force and consequently further increases the breaking strength of the joint between the handle 2*b* and the mesh 7. It is for this reason that it is desirable for the edge which determines the joint of the recess with the edge of the strip 1 to not be devoid of material due to cutting, forming a bevelled or rounded edge.

The invention claimed is:

1. A strip for the formation of handles or labels for fruit and vegetable product bags, the strip comprising a linear succession of handles or labels joined without interruption, each handle or label comprising a central portion and two opposite ends, each opposite end of shorter length than the central portion, two opposite ends of two successive handles or labels forming a joining area to be cut along an imaginary transverse cut line to separate the two successive handles or labels from the strip, wherein each handle or label comprises a transition area between each opposite end and the central portion, the transition area comprising on each side an edge that defines at least one recess or depression that narrows the strip relative to a width of the central portion immediately preceding the transition area and relative to a width of the opposite end immediately following the transition area, an inner contour of the at least one recess or depression is made up of a curved or a plurality of curved lines devoid of angles and inflexion points.

2. The strip according to claim 1, wherein the line which makes up the contour of the recess comprises a curve of constant radius greater than or equal to 6 mm which reaches or forms the bottom of the recess in an area extending towards the corresponding opposite end of the handle or label.

3. The strip according to claim 1, wherein the line which makes up the contour of said recesses joins a corresponding edge of the corresponding opposite end of the handle or label by a vertex having a sharp angular form.

4. The strip according to claim 1, wherein a vertex joining the line which makes up the contour of said recesses and a corresponding edge of the end of the handle or label is bevelled or rounded.

5. The strip according to claim 1, wherein the line which makes up the contour of the recesses comprises a first sector, which begins at an edge of the corresponding opposite end of the handle or label, that is straight or has a tangent which follows a direction essentially transverse to the strip.

6. The strip according to claim 1, wherein the opposite ends of each handle or label comprise a symmetrical strip portion with respect to a longitudinal axis of the strip of constant width and of a length between 10 and 20 mm.

7. The strip according to claim 1, wherein a maximum width of the opposite ends of each handle or label and a minimum width of the corresponding transition area follow the ratio:

$$D=(1.5\div 4)d.$$

8. The strip according to claim 1, wherein the recesses are all equal.

9. The strip according to claim 1, wherein each joining area is of symmetrical minor configuration with respect to a longitudinal axis of the strip and the separating imaginary transverse cut line, the recesses also being in symmetrical minor arrangement with respect to the longitudinal axis of the strip and the imaginary transverse cut line.

10. The strip according to claim 9, wherein in the transition area between each opposite end and the corresponding central portion, each handle or label is provided with a single recess or depression at both edges, the pair of recesses symmetrically arranged on either side of the strip determining respective necks in the strip of a width between 12 and 24 mm.

11. A strip for the formation of handles or labels-for fruit and vegetable product bags, the strip comprising:

a succession of handles or labels extending in a longitudinal direction, each handle or label comprising a central portion joined to a successive handle or label by a joint area that, when cut along an imaginary line transverse to the longitudinal direction separates the joint area into two parts, each part forming an end of a corresponding handle or label;

wherein each central portion, an immediately preceding joint area and an immediately succeeding joint area define a symmetrical structure with respect to a centerline of the central portion extending transverse to the longitudinal direction;

wherein each joint area is shorter in length along the longitudinal direction than an immediately succeeding central portion;

wherein each joint area is attached to the immediately succeeding central portion by a transition area, each transition area having a width measured orthogonally to the longitudinal direction that is smaller than a width of the central portion measured orthogonally to the longitudinal direction and that is smaller than a width of the joint area measured orthogonally to the longitudinal direction so that the transition area defines a reduced neck between the central portion and the joint area.

12. The strip according to claim 11, wherein a transition area is formed by at least one recess, an inner contour of the at least one recess or depression is made up of a curved or a plurality of curved lines.

13. The strip according to claim 12, wherein the curved or a plurality of curved lines are devoid of angles and inflexion points.

* * * * *